US008052255B2

(12) United States Patent
Nishida

(10) Patent No.: US 8,052,255 B2
(45) Date of Patent: Nov. 8, 2011

(54) INKJET PRINTERS AND METHODS FOR MOUNTING INK CARTRIDGES TO INKJET PRINTERS

(75) Inventor: Katsunori Nishida, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1025 days.

(21) Appl. No.: 11/746,632

(22) Filed: May 9, 2007

(65) Prior Publication Data

US 2007/0268346 A1 Nov. 22, 2007

(30) Foreign Application Priority Data

May 16, 2006 (JP) ..... 2006-136279

(51) Int. Cl.
*B41J 2/175* (2006.01)

(52) U.S. Cl. ..... 347/85

(58) Field of Classification Search ..... 347/84, 347/85, 86

See application file for complete search history.

(56) References Cited

U.S. PATENT DOCUMENTS

| | | | | |
|---|---|---|---|---|
| 6,582,068 | B2 * | 6/2003 | Ishizawa et al. | 347/85 |
| 6,969,161 | B2 * | 11/2005 | Kuwabara et al. | 347/85 |
| 7,278,722 | B2 * | 10/2007 | Sasaki et al. | 347/86 |
| 2005/0122380 | A1 | 6/2005 | Nakamura et al. | |
| 2005/0134663 | A1 | 6/2005 | Sasaki et al. | |
| 2005/0146577 | A1 | 7/2005 | Sasaki et al. | |
| 2005/0146578 | A1 | 7/2005 | Sasaki et al. | |
| 2005/0146579 | A1 | 7/2005 | Sasaki et al. | |
| 2005/0151812 | A1 | 7/2005 | Sasaki et al. | |
| 2006/0001717 | A1 | 1/2006 | Sasaki et al. | |
| 2007/0273736 | A1 | 11/2007 | Sasaki et al. | |

FOREIGN PATENT DOCUMENTS

| | | | |
|---|---|---|---|
| JP | H05-035284 | A | 5/1993 |
| JP | H05-035284 | U | 5/1993 |
| JP | 2003-300330 | A | 10/2003 |
| JP | 2005144680 | A | 6/2005 |
| JP | 2005-231220 | A | 9/2005 |

OTHER PUBLICATIONS

Japan Patent Office, Notice of Reasons for Rejection for Japanese Patent Application No. 2006-136279 (counterpart to above-captioned patent application), mailed May 24, 2011.

* cited by examiner

*Primary Examiner* — Anh T. N. Vo
(74) *Attorney, Agent, or Firm* — Baker Botts L.L.P.

(57) ABSTRACT

The present invention relates to an inkjet printer and methods for mounting ink cartridges. The cartridge has a case with an ink chamber and a first and second opening. The inkjet printer has a recording head, a buffer tank, and a mounting portion with an ink supply tube and an air intake tube. The method includes establishing fluid communication between an interior of the ink chamber and the ink supply tube via the first opening, and then establishing fluid communication between the interior of the ink chamber and the air intake tube via the second opening, where the pressure of the ink chamber interior is less than atmospheric pressure. The inkjet printer includes a buffer tank in communication with a recording head, a mounting portion having an ink supply tube and an air intake tube, and an ink cartridge including a case having a first and second opening.

11 Claims, 4 Drawing Sheets

INKJET PRINTERS AND METHODS FOR MOUNTING INK CARTRIDGES TO INKJET PRINTERS

CROSS-REFERENCE TO RELATED APPLICATION

The present application claims priority from Japanese Patent Application No. JP-2006-136279, which was filed on May 16, 2006, the disclosure of which is incorporated herein by reference in its entirety.

BACKGROUND OF THE INVENTION

1. Field of the Invention

The present invention relates generally to methods for mounting an ink cartridge to a mounting portion of an inkjet printer, and to inkjet printers.

2. Description of Related Art

In a known inkjet printer, a recording head is mounted on a carriage and an ink cartridge is configured to be removably mounted to the carriage. The carriage includes an ink supply needle communicating with the recording head, and an air intake needle communicating with the atmosphere. When the ink cartridge is mounted to the carriage, the ink supply needle and the air intake needle are in fluid communication with the interior of the ink cartridge, and the ink supply needle supplies ink from within the ink cartridge to the recording head.

In another known inkjet printer, a recording head and a tank are mounted on a carriage. When an ink cartridge is mounted to a mounting portion provided in the inkjet printer, ink within the ink cartridge is supplied to and temporarily stored within the ink tank, and from there, the ink is supplied to the recording head.

Nevertheless, when the pressure in the interior of an ink cartridge is greater than the outside atmospheric pressure, the pressure difference therebetween may cause ink to leak from the nozzles of a recording head. The ink may leak from the nozzles at the time when an ink cartridge is mounted to the mounting portion of an inkjet printer for the first time, or when a depleted ink cartridge is replaced with a new ink cartridge. Moreover, if the pressure in the interior of the ink cartridge is less than the outside atmospheric pressure, the pressure difference may cause air to flow into the recording head from the nozzles. The air flowing into the recording head may cause malfunctions in printer operation, such as printing failure.

Yet another known inkjet printer addresses this problem by providing fluid communication between the air intake needle and the interior of the ink cartridge, thereby equalizing the pressure in the interior of the ink cartridge with the atmospheric pressure before the ink supply needle is in fluid communication with the interior of the ink cartridge. Nevertheless, in this known inkjet printer, when an ink cartridge is mounted to a mounting portion of an inkjet printer for the first time, or when a depleted ink cartridge is replaced with a new ink cartridge, air may be trapped in an ink supply path between the ink cartridge and a portion of the printer, e.g., the recording head. The trapped air initially may enter the ink supply path when the ink cartridge is not mounted to the mounting portion.

In still another known inkjet printer, air also may be trapped between an ink supply tube of the mounting portion and a valve member of the ink cartridge when the ink supply tube contacts and applies a pressure to the valve member. The trapped air may cause malfunctions in printer operation, such as printer failure. Although the trapped air may be removed by drawing ink from the recording head through the nozzles, this procedure may waste a large amount of ink, thus decreasing ink cartridge life.

In a known ink cartridge and mounting portion, an air intake tube first penetrates through an air intake hole, and then an ink supply tube penetrates through an ink supply hole. Alternatively, an air intake tube penetrates through an air intake hole at the same time that an ink supply tube penetrates through an ink supply hole. In these cases, because the interior of ink chamber is depressurized, air enters the interior of the ink chamber rapidly through the air intake tube as the pressure of the interior of the ink chamber rises to meet the outside atmospheric pressure. As a result, air may remain trapped at an end of ink supply tube, or at a position adjacent to the end of ink supply tube.

SUMMARY OF THE INVENTION

Therefore, a need has arisen for methods for mounting an ink cartridge to an ink cartridge holder, and inkjet printers which overcome these and other shortcomings of the related art. A technical advantage of the present invention is that air caught during the mounting of an ink cartridge to a mounting portion may be efficiently removed, which reduces the amount of ink wasted during the process.

An embodiment of the present invention describes a method of mounting an ink cartridge to an inkjet printer, with the cartridge comprising a case having a first opening and second opening formed therethrough, and an ink chamber formed within the case. The inkjet printer comprises a recording head, a buffer tank, and a mounting portion comprising an ink supply tube and an air intake tube. The method comprises (a) establishing fluid communication between an interior of the ink chamber and the ink supply tube via the first opening, where the ink supply tube is configured to be in fluid communication with the buffer tank, and the buffer tank is configured to be in fluid communication with the recording head, and (b) establishing a fluid communication between the interior of the ink chamber and the air intake tube via the second opening, where the air supply tube is configured to be in fluid communication with the outside atmosphere. Step (a) takes place before step (b), and a pressure of an interior of the ink chamber is below an atmospheric pressure before step (a) is performed.

Another embodiment of the present invention describes a method of mounting an ink cartridge to an inkjet printer. The cartridge comprises a case having a first opening and second opening formed therethrough, and an ink chamber formed within the case. The method comprises the steps of (a) establishing fluid communication between the interior of the ink chamber and the exterior of the ink cartridge via the first opening, where the first opening is configured to supply ink from an interior of the ink chamber to an exterior of the ink cartridge when the inkjet printer performs a printing operation, and (b) establishing fluid communication between the interior of the ink chamber and the exterior of the ink cartridge via the second opening, where the second opening is configured to draw air from the exterior of the ink cartridge into the interior of the ink chamber proportionally to the supplied ink from the interior of the ink chamber to the exterior of the ink cartridge when the inkjet printer performs a printing operation. Step (a) takes place before step (b), and a pressure of an interior of the ink chamber is below an atmospheric pressure before step (a) is performed.

According to yet another embodiment of the present invention, an inkjet printer comprises a recording head, a buffer tank configured to be in fluid communication with the recording head, a mounting portion having an ink supply tube in fluid communication with the buffer tank and an air intake tube in fluid communication with the atmosphere, and an ink cartridge. The ink cartridge comprises a case having a first opening and a second opening formed therethrough, and an ink chamber provided within the case, storing ink therein. The mounting portion and the ink cartridge are configured to (a) establish fluid communication between an interior of the ink chamber and the ink supply tube via the first opening, and to (b) establish fluid communication between the interior of the ink chamber and the air intake tube via the second opening. The ink supply tube is further configured to perform step (a) before step (b).

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

FIG. 2(*b*) is a partial, cross-sectional view of the ink cartridge and the mounting portion when the ink cartridge is mounted to the mounting portion, according to an embodiment of the present invention.

DETAILED DESCRIPTION OF EMBODIMENTS OF THE INVENTION

Embodiments of the present invention, and their features and advantages, are understood by referring to FIGS. 1-4, like numerals being used for like corresponding parts in the various drawings.

Figure 1:
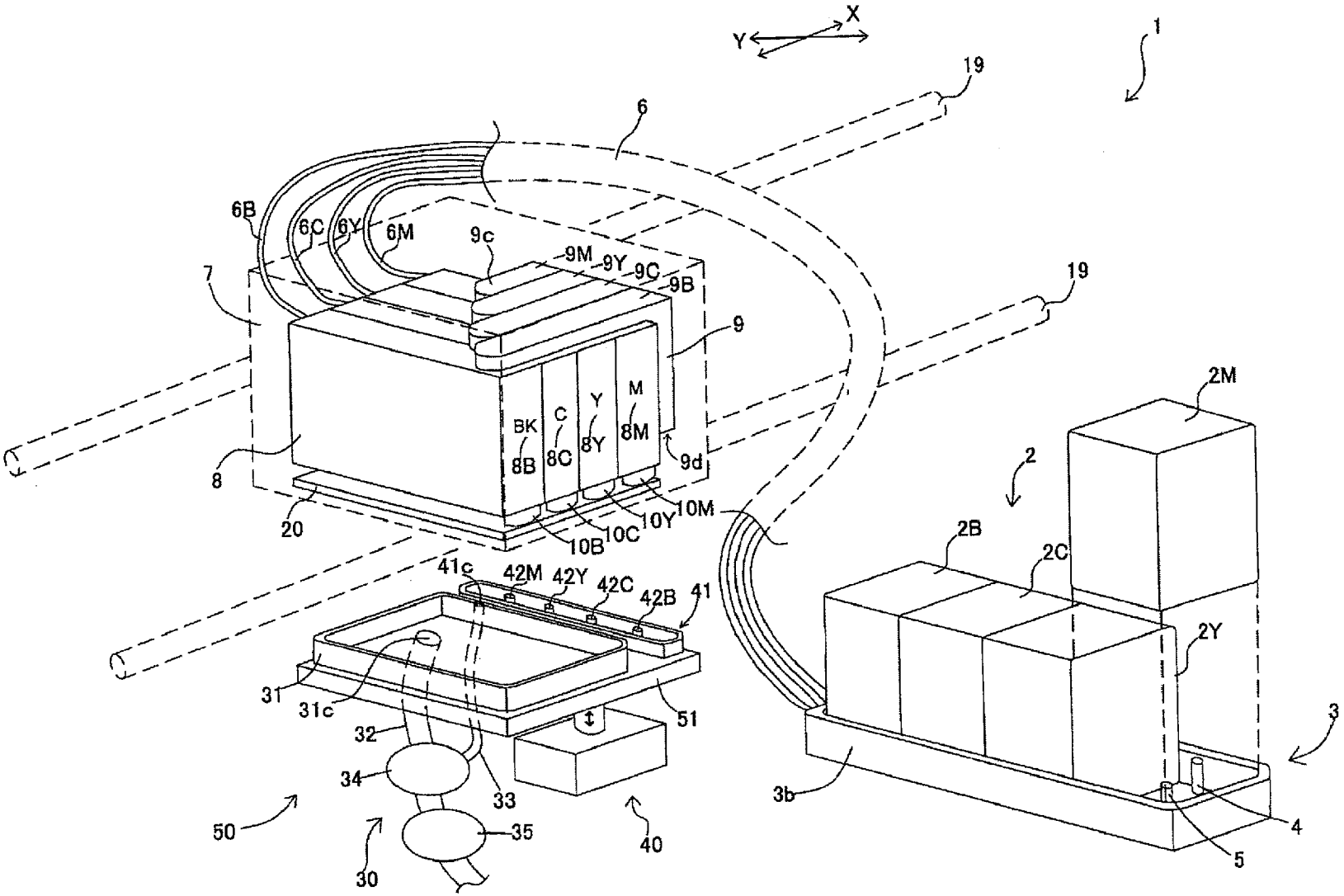
FIG. 1 is a perspective view of a portion of an inkjet printer, according to an embodiment of the present invention.

Referring to FIG. 1, an inkjet printer 1 according to an embodiment of the present invention may comprise a mounting portion 3, a flexible tube 6, a substantially box-shaped carriage 7, a buffer tank 8 mounted on carriage 7, and a recording head 20 having a plurality of nozzles formed therein. Mounting portion 3 may be configured to mount an ink cartridge 2. When ink cartridge 2 is mounted to mounting portion 3, ink cartridge 2 may be in fluid communication with recording head 20 via flexible tube 6 and buffer tank 8, and ink may be supplied from ink cartridge 2 to recording head 20. Carriage 7 may engage a plurality of guide bars 19, and also may be configured to slide on the plurality of guide bars 19. Recording head 20 may eject ink from the nozzles onto a recording medium when carriage 7 reciprocates along a plurality of guide bars 19, facilitating printing on the recording medium. In an embodiment of the present invention, recording head 20 may be substantially similar to the recording head disclosed in Patent Application Publication No. US 2005/0122380 A1, the disclosure of which is incorporated herein by reference, in its entirety.

Ink cartridge 2 may be a hollow box with ink stored therein. Ink cartridge 2 also may comprise four ink cartridges 2B, 2C, 2Y, and 2M for storing black ink, cyan ink, yellow ink, and magenta ink, respectively Buffer tank 8 may comprise four buffer tanks 8B, 8C, 8Y, and 8M for storing black ink, cyan ink, yellow ink, and magenta ink, respectively. Flexible tube 6 may comprise four flexible tubes 6B, 6C, 6Y, and 6M. When ink cartridge 2 is mounted to mounting portion 3, one end of each of ink supply tubes 6B, 6C, 6Y, and 6M may be connected to ink cartridges 2B, 2C, 2Y, and 2M, respectively. The other end of ink supply tubes 6B, 6C, 6Y, and 6M may be connected to buffer tanks 8B, 8C, 8Y, and 8M at connection portions 8*a*, respectively.

Ink may be supplied from ink cartridges 2B, 2C, 2Y, and 2M to buffer tanks 8B, 8C, 8Y, and 8M through ink supply tubes 6B, 6C, 6Y and 6M. After the ink reaches the buffer tanks 8B, 8C, 8Y, and 8M, the ink may be stored in buffer tanks 8B, 8C, 8Y, and 8M. Buffer tanks 8B, 8C, 8Y, and 8M may be positioned above recording head 20, which may be fixed to a bottom portion of carriage 7. Buffer tanks 8B, 8C, 8Y, and 8M may comprise ink outlet ports 10B, 10C, 10Y, and 10M, respectively, and ink outlet ports 10B, 10C, 10Y, and 10M may be connected to recording head 20. Buffer tanks 8B, 8C, 8Y, and 8M may be in fluid communication with recording head 20 through ink outlet ports 10B, 10C, 10Y, and 10M. Carriage 7 may have an opening formed through a bottom wall, exposing a nozzle surface of recording head 20, in which the plurality of nozzles may be formed.

Buffer tanks 8B, 8C, 8Y, and 8M may comprise air exhaust portions 9B, 9C, 9Y, and 9M, respectively. Air exhaust portions 9B, 9C, 9Y, and 9M may extend from positions at top surfaces of buffer tanks 8B, 8C, 8Y, and 8M to side surfaces of buffer tanks 8B, 8C, 8Y, and 8M, and then may extend downward along the respective side surfaces. Each of the air exhaust portions 9B, 9C, 9Y, and 9M may comprise an air passage 9*c*, which may be in fluid communication with one of the corresponding buffer tanks 8B, 8C, 8Y and 8M. Each air exhaust portion 9B, 9C, 9Y, and 9M may further comprise a valve disposed within air passage 9*c*. In one embodiment, during normal operation, the valve may close air passage 9*c* when recording head 20 ejects ink from the nozzles. When air passage 9*c* is closed by the valve, communication through air passage 9*c* may be prevented between buffer tanks 8B, 8C, 8Y, and 8M and an exterior of buffer tanks 8B, 8C, 8Y, and 8M.

When ink is supplied from ink supply tubes 6B, 6C, 6Y, and 6M, through buffer tanks 8B, 8C, 8Y, and 8M, to ink outlet ports 10B, 10C, 10Y and 10M, respectively, air contained in the ink may ascend and accumulate in upper portions of buffer tanks 8B, 8C, 8Y, and 8M and in air passages 9*c*. The air accumulated in upper portions of buffer tanks 8B, 8C, 8Y, and 8M may be in proportion to the ink supplied from the buffer tanks 8B, 8C, 8Y, and 8M. When the valve timely opens air passage 9*c*, the accumulated air may be exhausted to the exterior of buffer tanks 8B, 8C, 8Y, and 8M.

A maintenance unit 50 may be provided below two guide bars 19 at one end of inkjet printer 1 in a direction in which carriage 7 reciprocates. A wiper may be provided next to maintenance unit 50. The wiper also may be configured to wipe the nozzle surface of recording head 20. Maintenance unit 50 may comprise a maintenance main portion 51, a suction mechanism 30, and a lift mechanism 40. Maintenance main portion 51 further may comprise a suction cap 31 and an exhaustion cap 41 thereon. Suction cap 31 may be elastic and substantially rectangular-shaped, and may be configured to cover the nozzle surface. Exhaustion cap 41 may be elastic and substantially rectangular-shaped, and may be configured to cover respective lower end openings 9*d* of exhaust portions 9B, 9C, 9Y, and 9M. Lift mechanism 40 may be configured to move maintenance main portion 51 toward carriage 7, such that suction cap 31 covers the nozzle surface and exhaustion cap 41 covers lower end openings 9*d*. Lift mechanism 40 also may be configured to move maintenance main portion 51 away from carriage 7, such that suction cap 31 separates from the nozzle surface and exhaustion cap 41 separates from lower end openings 9*d*.

Suction mechanism 30 further may comprise a switch valve 34 and a suction pump 35, which may be in fluid communication with each other. A suction cap opening 31*c* may be formed through a bottom of suction cap 31. Similarly, an exhaustion cap opening 41*c* may be formed through a bottom of exhaustion cap 41. Suction cap opening 31*c* and exhaustion cap opening 41 may be in fluid communication with switch valve 34 through suction tubes 32 and 33, respectively. Switch valve 34 may be positioned between suction pump 35 and each of suction cap opening 31*c* and exhaustion cap opening 41*c*. Switch valve 34 may selectively establish fluid communication between suction cap 31 and suction pump 35. Switch valve 34 also may selectively establish fluid communication between exhaustion cap 41 and suction pump 35. Suction pump 35 further may be in fluid communication with a drain tank on a side opposite to suction cap 31 and exhaustion cap 41.

Exhaustion cap 41 may be configured to cover lower end openings 9*d* of air exhaust portions 9B, 9C, 9Y, and 9M, creating an airtight seal. At the bottom of exhaustion cap 41, protrusions 42B, 42C, 42Y, and 42M may be formed. Protrusions 42B, 42C, 42Y, and 42M may be configured to be lifted up and down by a second lift mechanism. Protrusions 42B, 42C, 42M, and 42Y further may be configured to apply a force to the valves disposed within air passages 9*c* when lifted. When the valves disposed within air passages 9*c* receive a force, passages 9*c* may be opened. When switch valve 34 is switched, exhaustion cap opening 41*c* and suction pump 35 may be placed in fluid communication with each other, and suction pump 35 may be driven, and air may be drawn out of buffer tanks 8B, 8C, 8Y, and 8M.

Suction cap 31 may be configured to cover the nozzle surface, creating an airtight seal. When switch valve 34 is switched, which may allow suction cap opening 31*c* and suction pump 35 to communicate with each other, suction pump 35 may be driven, and thickened ink or air containing ink may be sucked out of recording head 20.

Figure 2:
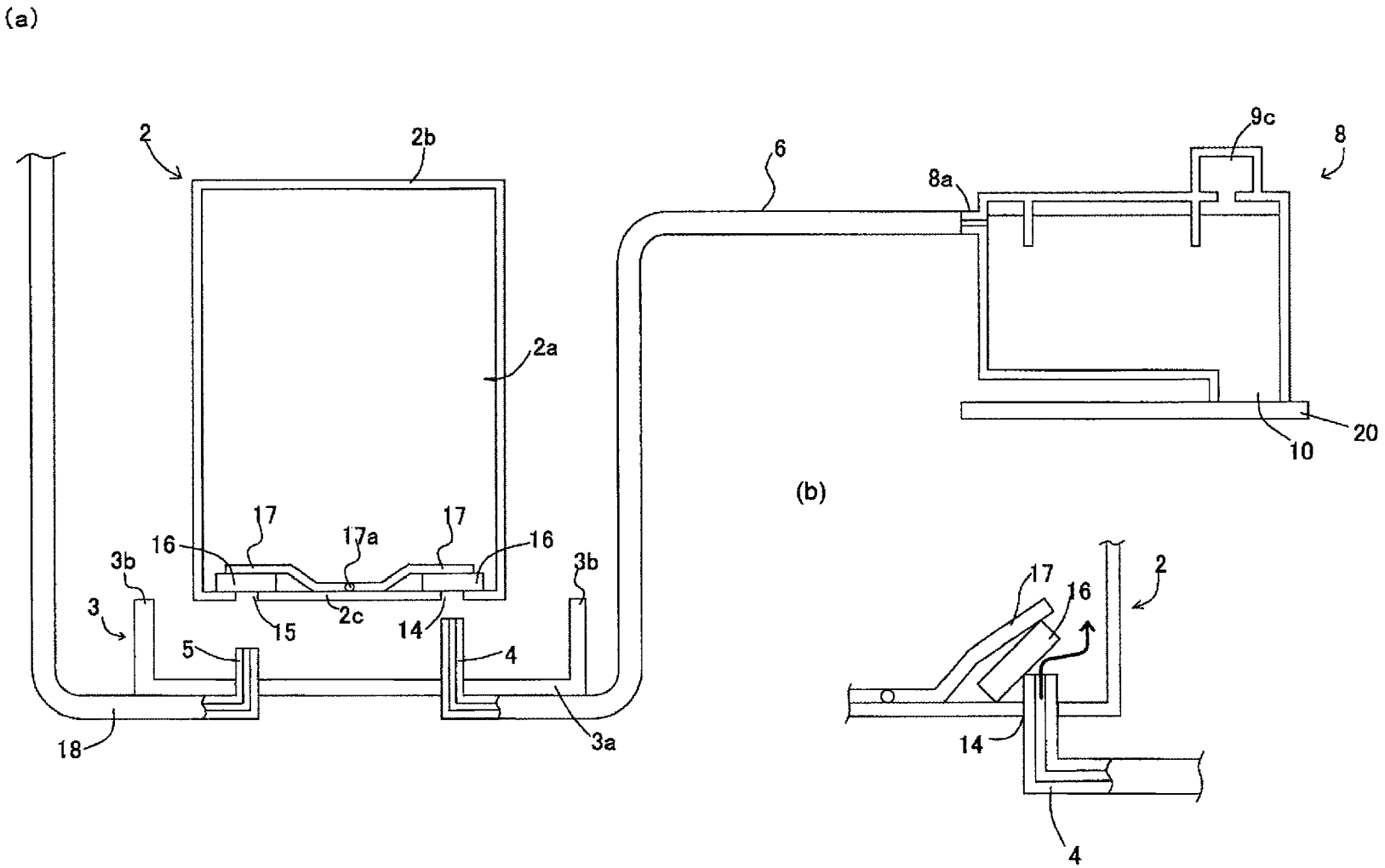
FIG. 2(*a*) is a cross-sectional view of an ink cartridge, a mounting portion, and a buffer tank, according to an embodiment of the present invention.

As shown in FIG. 2(*a*), mounting portion 3 may be positioned below the nozzle surface, and may have a base portion 3*a* and guide portions 3*b*. Guide portions 3*b* each may extend upward from the respective ends of base portion 3*a*. A hollow ink supply tube 4 and a hollow air intake tube 5 may be received in base portion 3*a*. The hollow ink supply tube 4 and the hollow air intake tube 5 may be configured to pass through base portion 3*a*, and also may be configured to extend upward from base portion 3*a*. Ink supply tube 4 and air intake tube 5 may be provided for each of ink cartridges 2B, 2C, 2Y, and 2M. Ink supply tube 4 may be connected to flexible tube 6 and may be in fluid communication with buffer tank 8 through flexible tube 6. Air intake tube 5 may be connected to flexible tube 18 and may be in fluid communication with the atmosphere through flexible tube 18. Ink supply tube 4 may extend from base portion 3*a* further than air intake tube 5 extends from base portion 3*a*.

As shown in FIG. 2(*a*), ink cartridge 2 may comprise a case 2*b* and an ink chamber 2*a* formed therein. Ink chamber 2*a* may store ink, and case 2*b* may comprise a resin. Before ink cartridge 2 is mounted to mounting portion 3, an interior of ink chamber 2*a* may be depressurized, such that the pressure of the interior of ink chamber may be less than the outside atmospheric pressure. When ink cartridge 2 is in transit, ink cartridge 2 may be packed within a package, and an interior of the package may be depressurized, such that the pressure of the interior of the package is less than the outside atmospheric pressure. Ink supply hole 14 and air intake hole 15 may be formed through a bottom wall of case 2*b*, and ink supply tube 4 may be configured to penetrate through ink supply hole 14 when ink cartridge 2 is mounted to mounting portion 3. Air intake tube 5 may be configured to penetrate through air intake hole 15, when ink cartridge 2 is mounted to mounting portion 3. Two valve members 16 may be disposed within ink chamber 2*a*, and one valve member 16 may cover ink supply hole 14. The covering of ink supply hole 14 by valve member 16 may prevent fluid communication between the interior of ink chamber 2*a* and an exterior of ink cartridge 2 through ink supply hole 14. The other valve member 16 may cover air intake hole 15 and may prohibit communication between the interior of ink chamber 2*a* and the exterior of ink cartridge 2 through ink supply hole 15.

A pressing member 17 may be disposed within ink chamber 2*a*. Pressing member 17 further may be fixed to case 2*b* at a fixing point 17*a*. Pressing member 17 may contact and elastically press two valve members 16 toward ink supply hole 14 and air intake hole 15, respectively. Valve members 16 and pressing member 17 may comprise a resin. As shown in FIG. 2(*b*), when ink cartridge 2 is mounted to mounting portion 3, ink supply tube 4 and air intake tube 5 may penetrate through ink supply hole 14 and air intake 15 respectively, and each of ink supply tube 4 and air intake tube 5 may contact and push up valve member 16, acting against the urging force exerted by pressing member 17. Thus, ink may be supplied into ink supply tube 4 from the interior of ink chamber 2*a*, and air may enter the interior of ink chamber 2*a* through air intake tube 5.

Ink cartridge 2 may be mounted to mounting portion 3 when suction cap 31 covers the nozzle surface and exhaustion cap 41 covers lower end openings 9*d* of exhaust portions 9B, 9C, 9Y, and 9M, while protrusions 42 may be positioned, such that protrusions 42 do not contact the valves disposed within air passages 9*c*, thus closing air passages 9*c*.

Figure 3:
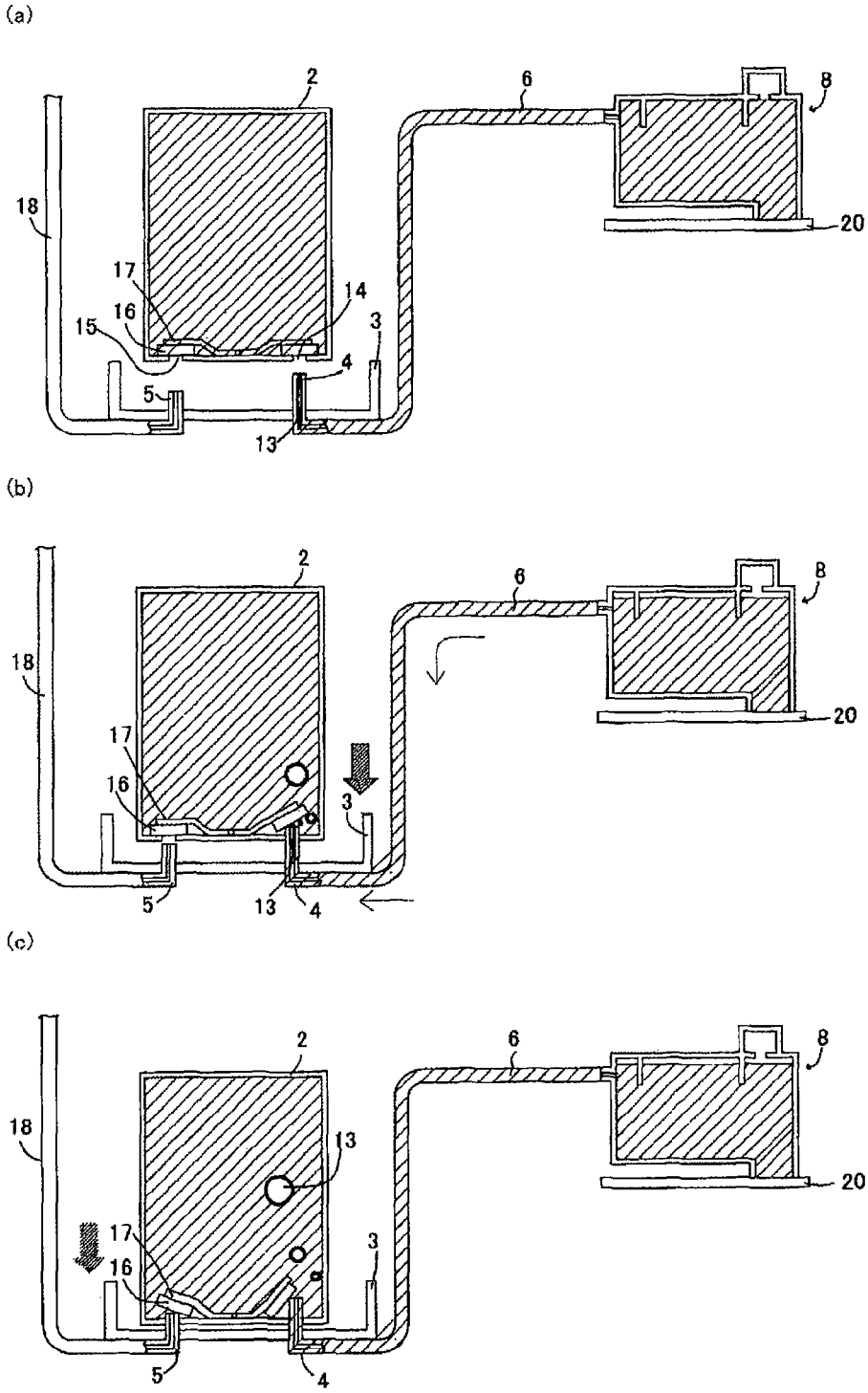
FIGS. 3(*a*), 3(*b*), and 3(*c*) are schematic diagrams illustrating how the ink cartridge is mounted to the mounting portion, according to an embodiment of the present invention.

As shown in FIG. 3(*a*), air 13 may exist within ink supply tube 4 when ink cartridge 2 is mounted to the mounting portion 3 of an inkjet printer for the first time, or when a depleted ink cartridge 2 is replaced with a new ink cartridge 2. Even when ink supply tube 4 is filled up with ink, air may be caught between the ink in ink supply tube 4 and valve member 16 when the ink supply tube 4 penetrates through ink supply hole 14.

In an embodiment of the present invention, as shown in FIG. 3(*b*), ink supply tube 4 may extend from base portion 3*a* further than the air intake tube 5 extends from base portion 3*a*. Therefore, an end of ink supply tube 4 may be positioned closer to ink cartridge 2 than an end of air intake tube 5 is positioned to ink cartridge 2. When ink cartridge 2 is mounted to mounting portion 3, ink supply tube 4 may penetrate through ink supply hole 14, and may push up valve member 6. This may cause the interior of ink chamber 2*a* to be in fluid communication with ink supply tube 14 before air intake tube 5 may penetrate through air intake hole 15, and the interior of ink chamber 2*a* may be in fluid communication with air intake tube 5. In this state, because the interior of ink chamber 2*a* is depressurized, air 13 may be drawn into the interior of ink chamber 2*a* and ink may move from buffer tank 8 toward ink cartridge 2 through flexible tube 6. After air 13 is drawn into the interior of ink chamber 2*a*, air intake tube 5 may penetrate through air intake hole 15 and the interior of ink chamber 2*a* may be in fluid communication with air intake tube 5, as illustrated in FIG. 3(*c*).

Figure 4:
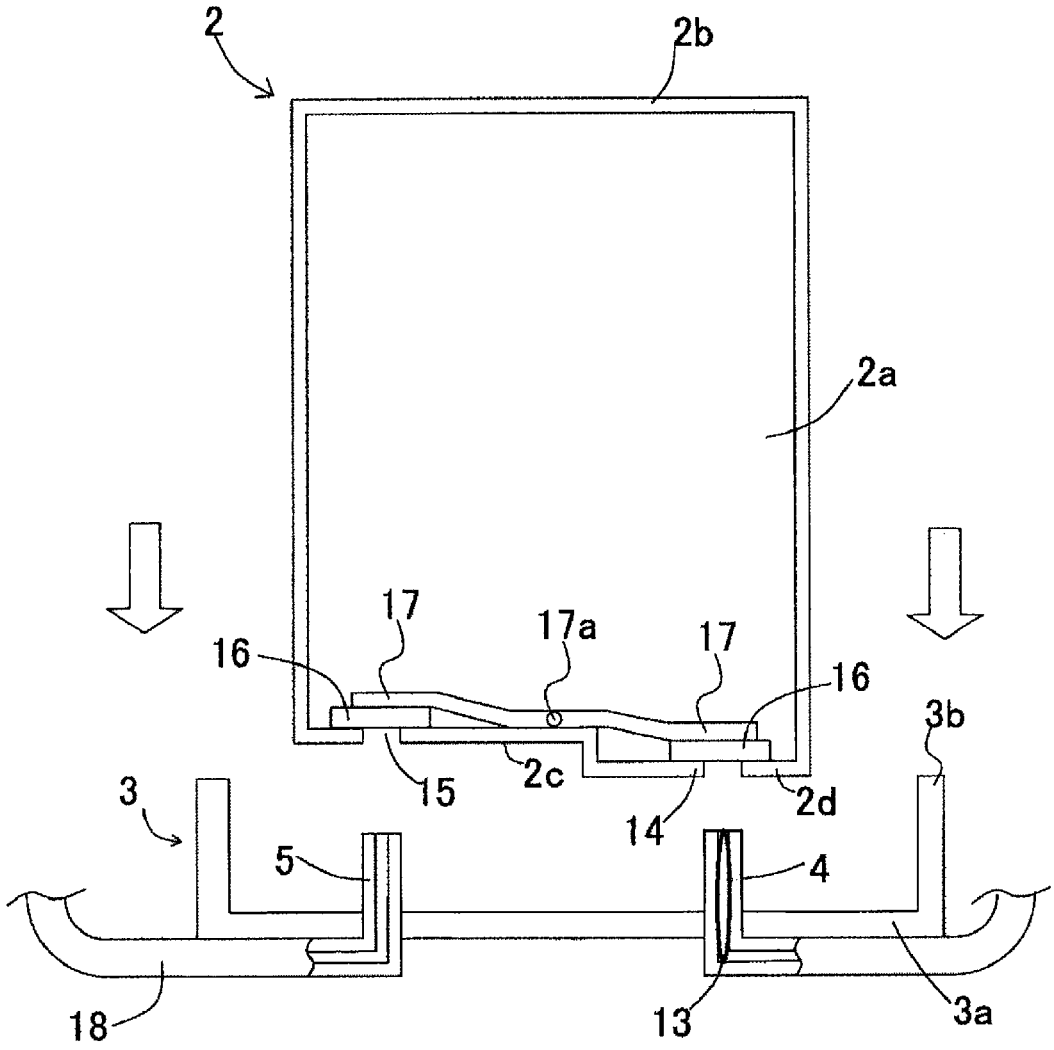
FIG. 4 is a cross-sectional view of an ink cartridge and a mounting portion, according to another embodiment of the present invention

FIG. 4 illustrates ink cartridge 2 and mounting portion 3 according to another embodiment of the present invention. In FIG. 4, ink supply tube 4 and air intake tube 5 may extend the same distance from base portion 3*a*. A bottom wall 2*c* of case 2*b* of ink cartridge 2 may be configured such that the side containing ink supply hole 14 of bottom wall 2*c* may protrude with respect to the side of bottom wall 2*c* containing air supply hole 15. Therefore, ink supply hole 14 may be positioned closer to mounting portion 3 than air intake hole 15 is positioned to mounting portion 3. When ink cartridge 2 is mounted to mounting portion 3, ink supply tube 4 may penetrate through ink supply hole 14, which may cause ink supply tube 4 to apply a force to valve member 6. The interior of ink chamber 2*a* thus may be in fluid communication with ink supply tube 14 before air intake tube 5 penetrates through air intake hole 15, and before the interior of ink chamber 2*a* may be in fluid communication with air intake tube 5. In this state, because the interior of ink chamber 2*a* is depressurized, air 13 is drawn into the interior of ink chamber 2*a*, drawing ink from buffer tank 8 into ink cartridge 2 through flexible tube 6. After air 13 is drawn into the interior of ink chamber 2*a*, air intake tube 5 may penetrate through air intake hole 15, allowing the interior of ink chamber 2*a* to be in fluid communication with air intake tube 5.

As described above, air 13 which may exist in ink supply tube 14 may be drawn into the interior of ink chamber 2*a*, and may ascend to an upper part of ink chamber 2*a*. Similarly, air trapped between the ink in ink supply tube 14 and valve member 16 may be drawn into the interior of ink chamber 2*a*, and may ascend to an upper part of ink chamber 2*a*. Accordingly, air may be removed from an ink path between ink cartridge 2 and buffer tank 8, thus decreasing the likelihood of printing failure due to air existing in the ink path. In addition, the amount of ink wasted during the process of removing the air may be reduced, thus increasing ink cartridge life and printer performance.

In an embodiment of the present invention, after ink cartridge 2 is mounted to mounting portion 3, menisci of ink in the nozzles of recording head 20 may retreat from their normal position or menisci of ink may be broken, due to ink moving out of buffer tank 8 and into flexible tube 6. Suction mechanism 30 may be driven while suction cap 31 covers the nozzle surface, and ink may be drawn out of nozzles, again supplying ink from ink cartridge 2 to buffer tank 8. As a result of this operation, meniscus of ink may return to the normal position. Negative pressure may be applied to ink in recording head 20 due to the ink level difference between the ink cartridge 2 and the nozzle surface, thus, maintaining the meniscus of ink in the normal position.

In an embodiment of the present invention, the ink drawing operation may be initiated by the pressing of a button provided on inkjet printer 1, after completion of the mounting of ink cartridge 2 to mounting portion 3. In another embodiment of the present invention, the ink drawing operation may be initiated automatically when inkjet printer 1 detects the completion of the mounting of ink cartridge 2 to mounting portion 3.

In yet another embodiment of the present invention, suction mechanism 30 may be driven while exhaustion cap 41 covers lower end openings 9*d* of air exhaust portions 9. After ink cartridge 2 is again mounted to mounting portion 3, as air is drawn out of buffer tank 8 via air exhaust portions 9, ink may be supplied from ink cartridge 2 into buffer tank 8. In this embodiment, suction mechanism 30 may be driven a predetermined time after the valves open air passages 9*c*. After another predetermined time, the valves may close air passages 9*c*, completing the operation.

In an embodiment of the present invention, suction cap 31 and exhaustion cap 41 may be lifted up and down independently by separate lift mechanisms. In this embodiment, when ink cartridge 2 is mounted to mounting portion 3, suction cap 31 may cover the nozzle surface, while exhaustion cap 41 may be separated away from the lower end openings 9*d* of air exhaust portions 9. Protrusions 42 may be integrally fixed to exhaustion cap 41, and may apply a force to valves disposed within air passages 9*c*, at the same time that exhaustion cap 41 covers lower end openings 9*d* of air exhaust portions 9. After ink cartridge 2 is mounted to mounting portion 3 and air 13 is drawn into ink chamber 2*a*, positive pressure may be applied to the ink in ink cartridge 2, supplying ink from ink chamber 2*a* to the buffer tanks.

As described above, in an embodiment of the present invention, air existing in an ink supply tube, or air trapped between ink in the ink supply tube and a valve member, may be drawn into an interior of the ink chamber. This air may be drawn into an interior of the ink chamber using a simple structure of an ink cartridge and a mounting portion, and a simple method for mounting the ink cartridge to the mounting portion. The amount of ink wasted when supplying ink from an ink cartridge to a buffer tank in the embodiments of the present invention may be less than the amount of ink wasted for removing the air and improving printing performance in the known inkjet printer.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are considered exemplary only, with the true scope of the invention indicated by the following claims.

What is claimed is:

1. A method of mounting an ink cartridge to an inkjet printer, wherein the cartridge comprises a case having a first opening and second opening formed therethrough, and an ink chamber formed within the case, wherein the inkjet printer comprises a recording head, a buffer tank, and a mounting portion comprising an ink supply tube and an air intake tube, wherein the method comprises the steps of:

(a) establishing fluid communication between an interior of the ink chamber and the ink supply tube via the first opening, wherein the ink supply tube is configured to be in fluid communication with the buffer tank, and the buffer tank is configured to be in fluid communication with the recording head; and (b) establishing fluid communication between the interior of the ink chamber and the air intake tube via the second opening, wherein the air supply tube is configured to be in fluid communication with an outside atmosphere, wherein step (a) is performed before step (b), and a pressure of the interior of the ink chamber is below an atmospheric pressure before step (a) is performed.

2. The method of claim 1, further comprising the steps of:

(c) supplying ink from the ink chamber to the buffer tank, wherein step (c) is performed after step (b).

3. The method of claim 2, wherein the step of supplying ink comprises the substep of drawing ink out of nozzles of the recording head.

4. The method of claim 2, wherein the step of supplying ink comprises the substep of applying a positive pressure to ink within the ink chamber.

5. A method of mounting an ink cartridge to an inkjet printer, wherein the cartridge comprises a case having a first opening and second opening formed therethrough, and an ink chamber formed within the case, wherein the method comprises the steps of:

(a) establishing fluid communication between the interior of the ink chamber and the exterior of the ink cartridge via the first opening, wherein the first opening is configured to supply ink from an interior of the ink chamber to an exterior of the ink cartridge when the inkjet printer performs a printing operation; and (b) establishing fluid communication between the interior of the ink chamber and the exterior of the ink cartridge via the second opening, wherein the second opening is configured to draw air from the exterior of the ink cartridge into the interior of the ink chamber proportionally to the supplied ink from the interior of the ink chamber to the exterior of the ink cartridge when the inkjet printer performs a printing operation, wherein step (a) is performed before step (b), and a pressure of the interior of the ink chamber is below an outside atmospheric pressure before step (a) is performed.

6. An inkjet printer, comprising:

a recording head;

a buffer tank configured to be in fluid communication with the recording head;

a mounting portion comprising:

an ink supply tube configured to be in fluid communication with the buffer tank; and an air intake tube configured to be in fluid communication with an atmosphere; and an ink cartridge comprising:

a case having a first opening and a second opening formed therethrough; and an ink chamber provided within the case and storing ink therein;

wherein the mounting portion and the ink cartridge are configured to:

(a) establish fluid communication between an interior of the ink chamber and the ink supply tube via the first opening; and (b) establish fluid communication between the interior of the ink chamber and the air intake tube via the second opening, wherein step (a) is performed before step (b).

7. The inkjet printer of claim 6, wherein each of the ink supply tube and the air intake tube has a first end and a second end positioned closer to the ink cartridge than the first end, wherein the second end of the ink supply tube is positioned closer to the ink cartridge than the second end of the air supply tube.

8. The inkjet printer of claim 6, wherein the first opening is positioned closer to the mounting portion than the second opening is positioned to the mounting portion.

9. The inkjet printer of claim 6, wherein the ink cartridge further comprises:

a first valve configured to selectively open and close the first opening; and a second valve configured to close the second opening, wherein the first valve is configured to open the first opening when the ink supply tube applies a force to the first valve, and the second valve is configured to open the second opening when the air intake tube applies a force to the second valve.

10. The inkjet printer of claim 6, further comprising a carriage configured to reciprocate, wherein the recording head and a buffer tank are mounted to the carriage.

11. The inkjet printer of claim 10, wherein the ink cartridge is configured to be in fluid communication with the buffer tank via a flexible tube.

* * * * *